United States Patent [19]

Rohs

[11] 3,939,809

[45] Feb. 24, 1976

[54] AXIAL-PISTON COMBUSTION ENGINE

[76] Inventor: Ulrich Rohs, Roonstrasse 11, D 516 Dueren, Germany

[22] Filed: Oct. 11, 1974

[21] Appl. No.: 513,990

[30] Foreign Application Priority Data

Oct. 12, 1974 Germany ..... 2351252

[52] U.S. Cl.... 123/58 B; 123/197 AC; 123/197 AB

[51] Int. Cl.[2] ..... F02B 75/26

[58] Field of Search ..... 123/58 B, 58 BA, 197 AB, 123/197 AL, 44 D, 43 R; 308/168, 170, 135

[56] References Cited

UNITED STATES PATENTS

| | | | |
|---|---|---|---|
| 3,171,509 | 3/1965 | Girodin | 123/58 BA X |
| 3,399,001 | 8/1968 | Whitaker | 308/170 X |
| 3,654,906 | 4/1972 | Airas | 123/58 B X |

FOREIGN PATENTS OR APPLICATIONS

| | | | |
|---|---|---|---|
| 807,885 | 1/1937 | France | 308/170 |

*Primary Examiner*—Charles J. Myhre
*Assistant Examiner*—William C. Anderson
*Attorney, Agent, or Firm*—Allison C. Collard

[57] ABSTRACT

Axial-piston combustion engine having a rotating drum journaled in a housing and having therein a number of pistons and the usual cylinder bores, an inclined crank disc coupled with the drum, the disc being supported against the encountered gas pressures both by the customary axial thrust bearing and, according to the invention, by two consecutive, hydraulically interconnected hydrostatic axial thrust bearings fed by an oil-pressure source, wherein only the rearward one of the two bearings has a slit for controlling oil pressure, while the rearward bearing of the two constitutes a hydraulic relief for the customary bearing.

11 Claims, 1 Drawing Figure

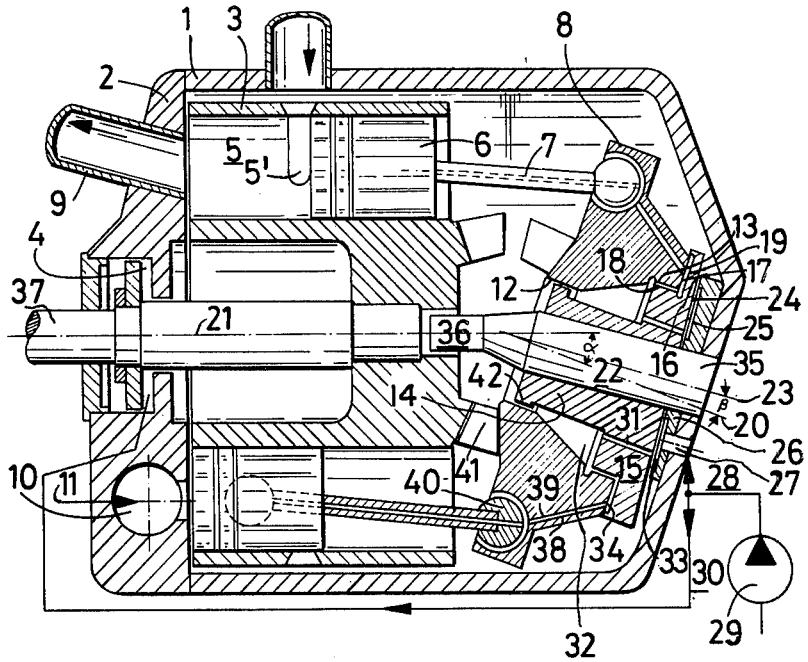
1
3
8
2
5
5'
6
7
9
4
13
19
18
17
37
12
24
21
36
25
16
35
22
42
23
14
31
20
26
10
11
40
41
39
15
28
27
38
34
33
30
32
29

AXIAL-PISTON COMBUSTION ENGINE

The invention relates generally to an axial-piston combustion engine comprising a rotating drum journaled in a stationary housing and provided with cylinder bores, with an inclined crank disc being coupled with the drum, to which disc rods of pistons are pivotally attached, which latter are guided in the cylinder bores.

In such an axial-piston engine, substantial axial gas-pressure forces act on the crank disc and its journaling. At the same time one has to insure that the drum is guided with the front face on the piston side tightly along the inner side of the housing face to avoid compression losses. This is particularly important if at least one combustion chamber is provided in the housing front face, this resulting in particular sealing problems.

It is the object of the present invention to provide support for the crank disc against the encountered axial thrust forces, the support being capable of receiving these thrust forces without substantial frictional forces even at high disc revolutions. With the hitherto used conventional axial thrust bearings this was not possible.

In accordance with major features of the invention, the combustion engine comprises a rotating drum journaled in a stationary housing and provided with cylinder bores, an inclined crank disc coupled with the drum, rods of pistons being pivotally attached to the disc, which pistons are guided in the cylinder bores, characterized in that the crank disc is supported against the encountered gas pressures, on the one hand, on a customary axial thrust bearing, and on the other hand, on two consecutive, hydraulically interconnected hydrostatic axial thrust bearings fed by an oil-pressure source, only the rearward one of the two thrust bearings having a slit for controlling the oil pressure, and the forward bearing constituting a hydraulic relief for the customary bearing.

As a result of the latter being connected in parallel with the forward bearing, and the forward bearing assuming the relief of the rearward bearing, the encountered axial thrust forces are taken up by both bearings in a primary manner.

It is considered advantageous in this connection that the useful bearing surface of the rearward thrust bearing is slightly larger than that of the forward bearing. This ensures that the normal bearing takes up a certain although small portion of the thrust forces so that satisfactory contact of the crank disc on the setting sleeve is guaranteed.

The necessary control of the forward bearing results herein from the surface difference between the bearings of which the rearward bearing has to take up the entire axial thrust force.

The invention recommends that the surface ratio of the rearward to the forward thrust bearing be about 100 : 95. In this case, the forward bearing takes up about 95% of the applied axial thrust forces while the usual bearing has to endure about 5% of the thrust forces, whereby smooth contact of the crank disc is ensured on the setting sleeve, and the entire axial journaling is statically determined.

A preferred embodiment according to the invention is further characterized in that the crank disc sits on a cylindrical setting sleeve that has a bore slanting with respect to its geometrical center axis, the rear portion of the sleeve being formed as a stepped flange, the inner and outer envelope surfaces of the sleeve constituting the forward thrust bearing, while another flange surface forms a bearing surface for the customary bearing, to which a corresponding surface of the crank disc is assigned.

Alternatively, the inner and outer envelope surfaces of the sleeve can simultaneously form hydrostatic radial bearings for the crank disc.

According to a further, similarly optional feature, the rear face of the setting sleeve rests on a pressure plate disposed on the housing, the front face of the plate forming a bearing surface for the rearward thrust bearing and being connected with the oil-pressure source by way of a bore.

Furthermore, at least one auxiliary bore may be provided in the stepped flange of the setting sleeve, which bore interconnects the two thrust bearings so that the oil pressure that is set through the control slit on the rearward bearing is transmitted onto the forward bearing.

An additional control effect of the hydrostatic axial thrust bearing is preferably obtained in that the rearward bearing is additionally in hydraulic connection with a hydrostatic axial thrust journaling on the drum-side face of the housing, and this journaling is fed with the oil pressure controlled by the control slit.

Advantageously it is also provided that the useful surfaces of the forward and reearward bearings define an angle which corresponds to that between the geometrical center axis of the setting sleeve and the bore of the same.

A further, specific embodiment of the invention consists in that a collecting device is provided for leak or overflowing oil on at least one of the hydrostatic bearings, which device is connected through conduits with the piston-rod journaling, or the rods themselves. It is hereby possible to guide possibly leaking oil directly to the piston rod where it can be brought in a usual manner as a coolant to the piston.

Further objects, features and advantages of the inventive axial-piston combustion engine will be fully explained in the description that follows, with reference to the sole figure of the accompanying drawing, which constitutes a longitudinal section of the exemplary engine.

The drawing shows a cylindrical housing 1 with a cover 2, in which a rotating drum 3 is supported in a hydrostatic axial thrust bearing 4. The drum 3 has a shaft 37, broken away on the left-hand side of the illustration. The drum 3 also has through cylinder bores 5 that are uniformly distributed about a pitch circle, are coaxial, and which have air-inlet slots 5', a number of pistons 6 being guided in the bores 5. Piston rods 7 act on the pistons 6 and they are uniformly pivoted to the circumference of an inclined, rotating crank disc 8. Each piston rod 7 has a head portion 40 within the crank disc 8. The latter is connected with the drum 3 by way of a jaw clutch 41 that is similar to a bevel gear. Instead of such a clutch a Cardan-type joint could also be used.

In the housing cover 2, which also serves as a cylinder head for all cylinder bores 5, are disposed an exhaust-gas conduit 9 and a sole combustion chamber 10 with a suitable fuel feed pipe 11 (schematically shown by an arrow). The chamber 10 is placed in successive communication with the bores 5 as the drum 3 rotates. The hydraulic circuit of the engine will be described somewhat later.

The crank disc 8 has a concentric bore 12, the rear end of which has a similarly shaped recess 13. The bore 12 and the recess 13 constitute hydrodynamic friction bearings of different diameters, with envelope surfaces 18, 42 of a setting sleeve 14 assigned to the bearing surfaces, the resulting annular surface constituting a support surface for a forward hydrostatic bearing 32. The other bearing, numbered 33, will be explained later.

Furthermore, a flange face 17 of the crank disc 8 and a similar flange face 19 of the setting sleeve 14 form a customary axial thrust bearing 34. The sleeve 14 has a flange portion 15, to be mentioned again later.

It should be noted that the inner and outer envelope surfaces 18, 42 can also form hydrodynamic radial bearings for the crank disc 8.

The setting sleeve 14, the geometrical center axis 20 of which defines a particular acute angle $\alpha$ with the center axis 21 of the drum 3, has an axle bore 22 that is inclined with respect to the center axis 20, and the geometrical axis 23 of which passes through the section point of the axes 20 and 21, and which defines an angle $\beta$ with the center axis 20 of the setting sleeve 14.

The rear end of the setting sleeve 14 is cut off at right angles with respect to the axle bore 22 and forms a bearing surface 24 which latter constitutes the earlier-mentioned hydrostatic bearing 33, with a control slit 16, together with a corresponding annular bearing surface 25 of a pressure plate 26 secured in the housing 1.

The bearing 33 is connected with an oil-pressure conduit 28 through a bore 27, the conduit being connected with an oil pump 29 and an oil-pressure conduit 30 which leads to the axial thrust bearing 4. The required oil pressure is set by means of the control slit 16.

In the drawing, the hydraulic circuit is only schematically shown with lines and arrows, including the schematic pump 29, which however will be understood by those skilled in the art.

Auxiliary bores 31 are provided in the flange 15 of the setting sleeve 14, which bores interconnect the thrust bearings 32 and 33.

The setting sleeve 14 sits on a trunnion 35 which passes through the setting sleeve 14 through an angle $\beta$. The forward end of the trunnion has an angularly bent journal part 36 which protrudes into a bore of the drum shaft 37. The rear portion of the crank disc 8 is surrounded by an annular housing 38 which is connected with the earlier-mentioned heads 40 of the piston rods 7 by way of respective bores 39. In the hollow piston rods 7 the leaking oil is led from the hydrostatic bearing 32 and from the axial thrust bearing 34 as a coolant to the pistons 6.

The construction described herein allows the adjustment of the setting sleeve 14 depending on the combustion-chamber pressure, whereby various load conditions can be obtained.

The combustion-chamber pressure is proportional to the axial force which has to be received in the axial thrust bearing because the value: piston surface $x$ combustion-chamber pressure corresponds to the axial thrust force. This, in turn, is proportional to the oil pressure which builds up in the hydrostatic system because the useful surface of a hydrostatic axial thrust bearing $x$ the oil pressure corresponds to the axial thrust forces to be received.

In the present case the two successively connected hydrostatic axial thrust bearings 32, 33 are provided, the surface of the bearing 33 being larger by a small degree than that of the bearing 32, namely at the ratio of about 100 : 95. It becomes possible hereby that hydrostatics take over 95% of the applied axial thrust forces while 5% thereof are absorbed by the normal axial thrust bearing 34. This allows unambiguous contact between the setting sleeve 14 and the crank disc 8.

When starting the engine, naturally full oil pressure is not yet available. In this case the normal bearing 34 takes over first the entire applied forces. They are then gradually decreased as the hydrostatic pressure is being built up. The serial connection of the two bearings 32, 33 is accomplished through the indicated auxiliary bore 31.

It is normally not possible to connect in parallel ordinary bearings, either roller or sliding bearings, with hydrostatic bearings because the latter have a much higher journaling rigidity. This however is possible with the embodiment according to the invention. The normal bearing 34 and the hydrostatic bearing 32 can take up together the applied axial thrust force. This is due, in the first place, to the control slit 16 between the journaling surfaces of the bearing 33, and to the circumstance that there is only one non-controlled relief in the hydrostatic axial thrust bearing 32. The non-controlled relief would however mean an indifferent equilibrium if the hydrostatic bearing 32 had to receive the entire axial thrust force.

By the constructive expedient that the latter bearing has to carry only one, although considerable, portion of the applicable axial thrust forces, namely 95 to 97%, a circumstance which is caused by the different sizes of the journaling surfaces, now a true parallel connection is achieved between the bearings 32 and 34.

Considering that very high axial thrust forces act on the cylinder head of the present axial-piston engine, which simply cause considerable forces of reaction from the sealing system, it is possible to provide a hydrostatic relief also on the cylinder head, which relief is brought into connection with the journaling 32, 33 by way of the conduit 30.

The axial thrust journaling of the drum in accordance with the present invention is particularly satisfactory at high drum speeds, and is obtained with a minimum of frictional forces. Consequently the journaling itself contributes to a high efficiency of the described engine.

It should be understood, of course, that the foregoing disclosure relates only to a preferred, exemplary embodiment of the invention, and that it is intended to cover all changes, optional features and modifications of the example described which do not constitute departures from the spirit and scope of the invention.

I claim:

1. An axial-piston combustion engine comprising, in combination, a rotating drum (3) journaled in a stationary housing (1) and provided with cylinder bores (5), an inclined crank disc (8) coupled with said drum, pistons (6) with their rods (7) being pivotally attached to said drum, said pistons being guided in said cylinder bores, wherein said crank disc is supported against the encountered gas pressures, on the one hand, on a customary axial thrust bearing (34), and on the other hand, on two consecutive, hydraulically interconnected series arranged hydrostatic axial thrust bearings (32, 33) fed by an oil-pressure source (28 to 30), only the rearward one (33) of said two thrust bearings having a control slit (16) for controlling oil pressure, and the other one (32) of said two bearings constituting a hydraulic relief for said customary bearing.

2. The axial-piston combustion engine as defined in claim 1, wherein the effective bearing surface of said rearward thrust bearing (33) is slightly larger than that of said forward bearing (32).

3. The axial-piston combustion engine as defined in claim 2, wherein the ratio between the effective bearing surfaces in said rearward (33) and said forward (32) thrust bearing is about 100 : 95.

4. The axial-piston combustion engine as defined in claim 1, wherein said crank disc (8) surrounds a cylindrical setting sleeve (14) that has a bore (22) slanting with respect to its geometrical center axis (20), the rear portion of said sleeve being formed as a stepped flange (15), the inner (42) and outer (18) envelope surfaces of said sleeve constituting said forward thrust bearing (32), while another flange surface (19) forms a bearing surface for said customary bearing (34), to which a corresponding surface (17) of said crank disc (8) is assigned.

5. The axial-piston combustion engine as defined in claim 4, wherein said inner (42) and said outer (18) envelope surfaces of the sleeve (14) also constitute hydrostatic radial bearings for said crank disc (8).

6. The axial-piston combustion engine as defined in claim 4, wherein the effective surfaces of said two thrust bearings (32, 33) define an angle which corresponds to that ($\beta$) between the geometrical center axis (20) and said bore (22) of the setting sleeve (14).

7. The axial-piston combustion engine as defined in claim 1, wherein the rear face (24) of said setting sleeve (14) rests on a pressure plate (26) disposed in said housing (1), the front face (25) of said plate forming a bearing surface for said rearward thrust bearing (33) and being connected with said oil-pressure source (28 to 30) by way of a bore (27).

8. The axial-piston combustion engine as defined in claim 1, wherein at least one auxiliary bore (31) is provided in said stepped flange (15), which bore interconnects said two thrust bearings (32, 33) so that the oil pressure that is set through said control slit (16) of the rearward bearing (33) is transmitted to said forward bearing (32).

9. The axial-piston combustion engine as defined in claim 1, further comprising a hydrostatic axial thrust journaling (4) on the drum-side face of said housing (1), and an additional hydraulic connection (30) between said rearward thrust bearing (33) and said hydrostatic journaling, the latter being fed with the oil pressure controlled by said control slit (16).

10. The axial-piston combustion engine as defined in claim 1, further comprising a collecting device (38) for leak oil on at least one of said hydrostatic thrust bearings (32, 33), said device being connected through conduits (39) with said piston rods (7).

11. The axial-piston combustion engine as defined in claim 1, wherein said axial thrust bearing and one of said hydrostatic axial thrust bearings are arranged in parallel.

* * * * *